United States Patent [19]

Bushey

[11] 4,154,894

[45] * May 15, 1979

[54] PROCESS FOR TREATING OLIVINE FOUNDRY SAND

[75] Inventor: William R. Bushey, Wilmington, Del.

[73] Assignee: E. I. Du Pont de Nemours and Company, Wilmington, Del.

[ * ] Notice: The portion of the term of this patent subsequent to Sep. 19, 1995, has been disclaimed.

[21] Appl. No.: 902,917

[22] Filed: May 5, 1978

[51] Int. Cl.[2] ..... C08K 9/02

[52] U.S. Cl. ..... 428/404; 427/214; 427/215; 260/38; 106/288 B; 106/308 M

[58] Field of Search ..... 427/215, 214, 221; 260/38; 428/404, 405; 106/288 B

[56] References Cited

U.S. PATENT DOCUMENTS 3,745,139 7/1973 Kachur ..... 260/38

*Primary Examiner*—Sam Silverberg

[57] ABSTRACT

Process for treating olivine foundry sand by intimately contacting the sand with an aqueous solution of an alkali metal silicate and isolating the sand from the solution. The treated sand exhibits exceptionally high tensile strength and is useful as a component of resin molds and cores.

5 Claims, No Drawings

PROCESS FOR TREATING OLIVINE FOUNDRY SAND

DESCRIPTION

Technical Field

This invention relates generally to olivine foundry sand and, more particularly, to a process for treating olivine foundry sand with an alkali metal silicate to improve the tensile strength of resinshell molds or cores in which the treated sand is used.

Background Art

Olivine foundry sands are a group of mineral sands of which forsterite ($Mg_2SiO_4$) and fayalite ($Fe_2SiO_4$) are examples. These two minerals are seldom found by themselves but are common in isomorphous mixture. The usual mixture in which the magnesium silicate predominates is commonly known as olivine. Olivine foundry sands have been utilized in a variety of foundry applications where a moderate degree of thermal stability is required. In applications where a high degree of thermal stability is required, olivine foundry sands have not been used because they have not been found to provide sufficiently high thermal stability. However, olivine is superior to silica sands and is particularly preferred for use in situations where the amount of free silica dust must be minimized. Consequently, olivine can provide a relatively low-cost silica-free sand for use in the foundry industry.

Resin-shell molds and cores are conventionally prepared by contacting a mixture of resin and foundry sand or, preferably, a resin-coated sand with a preheated metal pattern. The resin, upon curing, acts to bind the particles of sand in the form of the metal pattern. Because the resin mold must be strong enough to contain the molten metal until it solidifies, sufficient resin binder must be present so that the resin-shell mold will maintain structural integrity during the solidification process. Traditionally about 3% by weight of resin is the minimum required for a sufficiently strong bond with zircon. Silica sand generally requires 5% by weight to obtain a bond of similar strength, while olivine does not exhibit sufficient strength even at that high loading. At amounts of resin high enough to insure structural integrity of the mold, defects caused by the decomposition of the resin can occur. These "gas defects" are caused by the penetration of gaseous decomposition products into the molten or solidifying metal and result in pinholes and scarring of the resulting metal shape. Furthermore, because the mold must collapse after solidification, high amounts of resin can at least partially prevent collapse of the mold and cause shake-out problems.

DISCLOSURE OF THE INVENTION

This invention provides for a process for treating olivine foundry sand in such a way that the resulting sand exhibits increased tensile strength or bond strength when bonded with thermosetting resins.

According to the invention there is provided a process for treating olivine foundry sand by (i) intimately contacting the olivine sand with an aqueous solution containing at least 0.1 g/l, and preferably from 0.4 to 6.0 g/l, of an alkali metal silicate and (ii) isolating the olivine sand from the aqueous solution.

The olivine foundry sand prepared in accordance with the invention can be incorporated in resin molds in the conventional manner and provides resin molds generally exhibiting at least twice the tensile strength of molds containing olivine foundry sand which has not been treated with an alkali metal silicate in accordance with the invention and a tensile strength which is at least equal to zircon-containing foundry sand at the same resin loading.

The olivine foundry sand generally consists essentially of from 67% to 74% by weight of magnesium silicate ($Mg_2SiO_4$), based on the weight of the sand, and from 11% to 20% by weight of iron silicate ($Fe_2SiO_4$), the balance being composed of minor silicate impurities. The olivine foundry sand can be a naturally occurring mineral sand or a mixture of mineral sands. Olivine sand itself is a commercially available naturally occurring mineral sand consisting essentially of magnesium silicate and iron silicate with minor amounts of free silica, e.g., less than 2% by weight, and commonly less than 0.5% by weight, calculated as $SiO_2$.

The olivine foundry sand prepared according to the invention is believed to consist essentially of particulate olivine sand and from 0.006% to 0.2% by weight of an alkali metal silicate. Sodium silicate is preferred for reasons of availability and economics. The alkali metal silicate is believed to be in the form of a surface coating on the olivine sand particles. The surface coating may not be continuous and may consist of particles of alkali metal silicate in separate association with the surface of the sand particles.

The olivine foundry sand is treated by intimately contacting the olivine sand with an aqueous solution of alkali metal silicate. Intimate contact can conveniently be achieved by stirring a slurry of olivine sand and aqueous alkali metal silicate. The temperature at which the contact is made is not particularly critical and any temperature at which the aqueous solution is fluid can be employed but, for convenience, ambient temperature is preferred.

To provide sufficient alkali metal silicate to contact substantially all the surface of the olivine sand particles, the aqueous solution should contain at least 0.1 g/l of alkali metal silicate and sufficient solution to wet all surfaces of the sand should be used. The upper limit of the concentration of the alkali metal silicate is the limit of the solubility of the particular alkali metal silicate chosen. To provide the best combination of adequate surface treatment and economy, a concentration of 0.4 g/l to 6.0 g/l is preferred.

The duration of the contact depends primarily on the concentration of the aqueous solution of alkali metal silicate, i.e., the less the concentration of the aqueous solution, the greater the contact time. If the aqueous solution is at the lowest recommended concentration, i.e., 0.1 g/l, several hours are usually necessary to achieve adequate surface treatment, whereas at highest concentrations less than five minutes is usually necessary, assuming mild agitation at room temperature. In the preferred concentration range from 0.4 g/l to 6.0 g/l, 30 minutes of mild agitation, such as provided by stirring, is adequate.

The silicate-treated olivine sand can be isolated from the slurry by conventional means, such as filtration. The isolated composition can be dried, without further treatment, or washed with water prior to drying, and used to form resin molds. For processing convenience and highest performance in use, it is preferred that the isolated olivine sand composition not be washed prior to drying. However, in either case the isolated silicate-treated olivine sand exhibits superior performance as a resin mold relative to untreated olivine sand.

The silicate-treated olivine sand of the invention can be utilized in forming resin-shell molds or cores in the same way as is currently practiced using conventional zircon sand, olivine sand and silica sand. The process of preparing resin-shell molds is well known in the art and is described in detail in Chapter 21, pages 207–232 of Harry W. Dietert, Foundry Core Practice, Third Edition, American Foundrymen's Society, Des Plaines, Illinois, 1966. The entire disclosure of that chapter is hereby incorporated by reference and portions of that chapter dealing with preferred practice are discussed below.

To form a resin-shell mold the silicate-treated olivine sand is mixed with a thermosetting resin, i.e., a polymer which does not melt at elevated temperatures. It is preferred that the sand and resin be mixed in such a way as to coat the sand particles to alleviate dusting and form a more uniform mold. A common procedure to coat the sand involves thoroughly manually or mechanically mixing the sand with a resin solution.

By far the most common resins utilized in resin-shell molding are phenol-formaldehydes. These resins are known as the "two-step" resins, because two basic process steps are practiced in preparing them. First, a phenolic resin, referred to as novalak, is prepared. Then the phenolic resin is mixed with hexamethylenetetramine, known as hexa, and a reaction between the phenolic resin and the formaldehyde in the hexa takes place to form the phenol-formaldehyde resin upon curing.

Resins, known in the art as "no-bake" resins, can also be utilized in forming resin molds. No-bake resins require no external heating to cure and the most commonly used no-bake resin of the thermosetting type is furan. Furan resins are thermosetting resins derived from the catalyzed polymerization of monomers such as furfuryl alcohol at ambient temperatures. Unlike phenolic resins, furan resins require no external heating to cure. However, sand coated with furan monomer cannot be stored without curing taking place.

In general a resin-coated olivine foundry sand will consist essentially of from 95% to 99.5% by weight of the olivine foundry sand, based on the weight of the resin-coated olivine foundry sand and from 0.5% to 5% by weight of resin, based on the weight of the resin-coated olivine foundry sand.

After the sand and resin are thoroughly mixed the resin-coated sand is placed in a mold and, in the case of phenolic resins, heated to temperatures from 210° to 430° C. for a few minutes to several hours depending on the size of the sample. When the silicate-treated olivine sand of the invention is utilized as the sand component of the mold, the resulting mold generally exhibits ten times the tensile strength of the mold using conventional olivine sand at the same resin loading.

While this invention is not bound by any particular theory of operation, it is believed that the strength of a mold made from olivine sand and phenolic resin is a function of trace impurities on the surface of the sand. These surface impurities can interfere with the formation of a strong resin to sand bond and thus lower the strength of the mold.

While it may seem that impurities might be removed by washing the olivine with base, it has been found that washing the olivine sand with an aqueous buffer solution of potassium carbonate and potassium borate at pH 10, while improving the tensile strength by a factor of about 6 over untreated sand, is comparable to the improvement obtained by merely washing the sand with water. In contrast, the alkali metal silicate solutions used in accordance with the invention, which also have a pH of about 10, provide a silica-treated olivine sand which has far superior strength in resin molds.

To investigate the potential advantages of this invention on other mineral sands, silica and chromite sands were treated with silicate in accordance with the invention and incorporated into resin molds. For these sands no improvement in tensile strength was found.

BEST MODE

EXAMPLE 1

An aqueous solution containing 2.8 g/l of sodium silicate is prepared by adding 10 g of a commercially available sodium silicate solution containing 28% by weight of sodium silicate to one liter of water. Five hundred grams of olivine sand having an average mesh size of 70, i.e., 210 micrometer diameter, is added to one liter of the aqueous solution of sodium silicate previously prepared. The resulting aqueous slurry of olivine sand is stirred for 30 minutes. The silicate-treated olivine sand is removed from the slurry by filtration and dried.

To determine the tensile strength, 500 g of the silicate-treated olivine sand is mulled in a mortar and pestle with 21.6 g of a commercially available novalak (phenolic) resin and 2.54 g of an accelerator consisting of 75% by weight of hexamethylenetetramine and 25% by weight of calcium stearate. Mulling is continued until a homogeneous mix is obtained. When the consistency of the mix prevents the further use of the mortar and pestle, a metal spatula is used to expose more surface area by repeatedly slicing the doughy mass. This enhances the evaporation of the solvent containing the binder. As the sand and binder mixture begins to dry, the mortar and pestle is again used to mull the sand until it will pass through a 60-mesh screen.

The coated sand is placed in a steel die designed to produce a test sample in the shape of a dog bone with a cross-sectional area of one inch (2.54 cm) by ¼ inch (0.63 cm). The coated sand is pressed into the die using a metal plate to cover the coated sand and tapping gently, but firmly, with a hammer. This method produces a test sample of coated sand weighing about 46 g. The die is placed on a hot plate at 225° C. for seven minutes to preheat the die and sample. The die and sample are then placed in an oven, heated to 335° C., for 11 minutes to finally cure the sample. The cured sample and die are air cooled, after which the cured sample is removed from the die and filed to remove any rough edges which may be present. The cured sample contains about 5% by weight of phenol-formaldehyde resin, based on the weight of the resin-coated silicate-treated olivine sand.

The cured sample is tested for tensile strength by placing it in a jig designed to accommodate the sample. The sample is then extended lengthwise until it breaks on a Model TTC, Instron Tensile Tester. The average tensile strength is found to be 320 pounds per square inch, i.e., 2210 kPa, based on the tensile strength of four identically prepared samples.

CONTROL 1

The procedure of Example 1 is followed except that the olivine sand is not slurried in the aqueous sodium silicate solution prior to coating with the resin.

The average tensile strength is found to be less than 30 pounds per square inch, i.e., 207 kPa.

INDUSTRIAL APPLICABILITY

Olivine foundry sand treated in accordance with this invention provides a more economical substitute for zircon-containing foundry sands in applications requiring particularly high tensile strength. At the same time the olivine sand treated in accordance with the invention can be handled in the same way as conventional olivine sands and requires no changes in present foundry technology.

I claim:

1. A process for treating olivine foundry sand to improve the bonding strength of thermosetting resins in molds made therefrom by (i) intimately contacting olivine sand with an aqueous solution containing at least 0.1 g/l of an alkali metal silicate, and (ii) isolating the silicate-treated olivine sand from the aqueous solution.

2. A process for preparing an olivine sand composition according to claim 1 wherein the aqueous solution contains from 0.4 g/l to 6.0 g/l of an alkali metal silicate.

3. A process for preparing an olivine sand composition according to claim 2 wherein the alkali metal silicate is sodium silicate.

4. An olivine foundry sand prepared according to the process of claim 1.

5. A resin-coated olivine foundry sand consisting essentially of from 95% to 99.5% by weight of the olivine foundry sand, based on the weight of the resin-coated sand, prepared according to the process of claim 1 and from 0.5% to 5% by weight of thermo-setting resin, based on the weight of the resin-coated sand.

* * * * *